United States Patent [19]

Young

[11] Patent Number: 4,913,669

[45] Date of Patent: Apr. 3, 1990

[54] BOAT PROPULSION APPARATUS

[76] Inventor: Ronald G. Young, 2698 Camcrest Drive, Nanaimo, B.C., Canada, V9T 4W4

[21] Appl. No.: 240,524

[22] Filed: Sep. 6, 1988

[51] Int. Cl.[4] ..... B63H 1/36

[52] U.S. Cl. ..... 440/14; 440/94

[58] Field of Search ..... 440/13, 14, 15, 16, 440/17, 18, 19, 20, 94; 416/79, 82, 83

[56] References Cited

U.S. PATENT DOCUMENTS

| | | | |
|---|---|---|---|
| 35,451 | 6/1862 | Johnson | 416/81 |
| 659,858 | 10/1900 | Palmer | 440/14 |
| 706,198 | 8/1902 | Phares | 440/13 |
| 1,068,665 | 7/1913 | Juberg | 440/13 |
| 1,116,117 | 11/1914 | Pullen | 440/13 |
| 1,130,153 | 3/1915 | Dennis | 440/14 |
| 1,937,907 | 12/1933 | Nock | 440/14 |
| 3,508,840 | 4/1970 | Lederlin | 416/79 |
| 4,490,119 | 12/1984 | Young | 440/14 |

FOREIGN PATENT DOCUMENTS

| | | | |
|---|---|---|---|
| 1650772 | 3/1978 | Fed. Rep. of Germany | 416/83 |

*Primary Examiner*—Joseph F. Peters, Jr.
*Assistant Examiner*—Jesus D. Sotelo
*Attorney, Agent, or Firm*—Vernon J. Pillote

[57] ABSTRACT

A boat propulsion apparatus having a thrust blade mounted for swinging movement about a generally horizontal swing axis lengthwise of the boat and for turning movement about an upright blade axis, and a swash plate drive for simultaneously swinging the blade about the swing axis in a direction crosswise of the boat and for angularly oscillating the blade about the blade axis to sinusoidally vary the pitch of the blade as the blade is swung crosswise of the boat. A planetary gear type mechanism is provided for adjusting the angle of the swash plate while the boat propulsion apparatus is in operation or when it is stopped. The thrust blade is connected to the blade shaft through an overload release coupling to prevent damage to the thrust blade and propulsion apparatus in the event the thrust blade strikes an obstruction. An improved arrangement for mounting the thrust blade on the swing shaft and for sealing the thrust blade to an enclosure for the boat propulsion apparatus, is also disclosed.

22 Claims, 8 Drawing Sheets

Fig. 3.
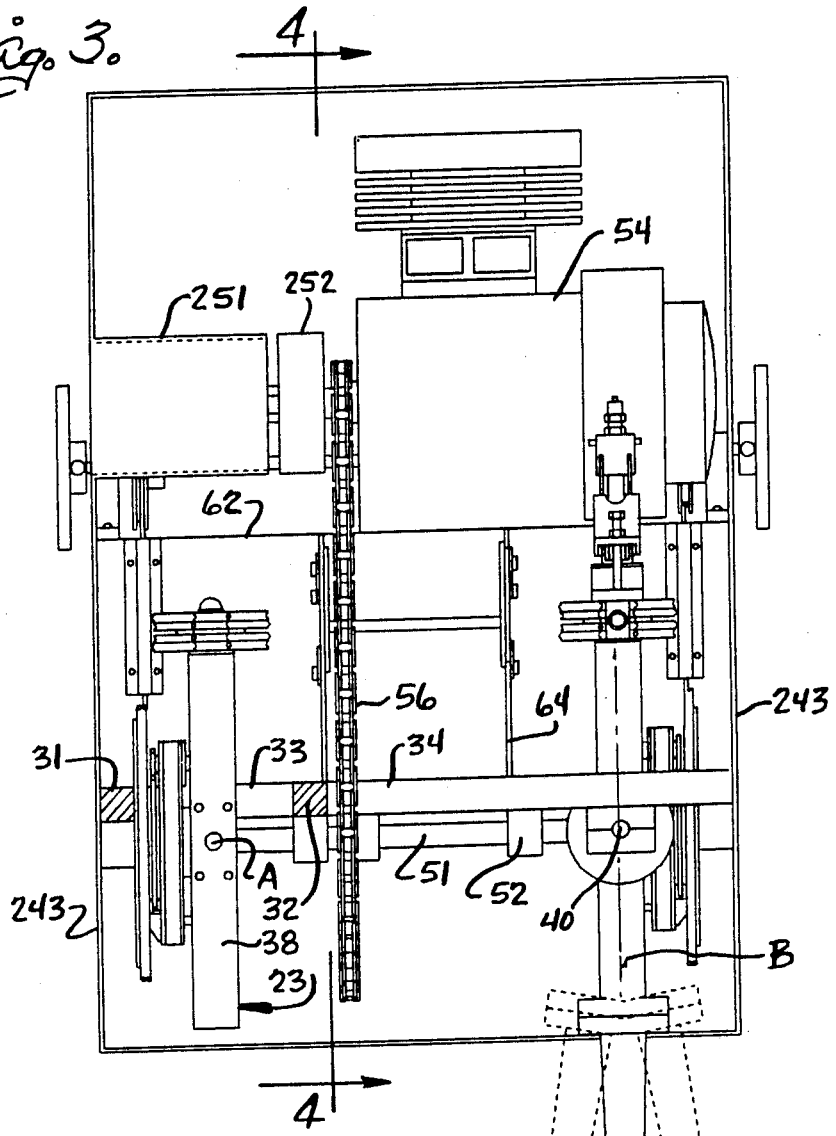
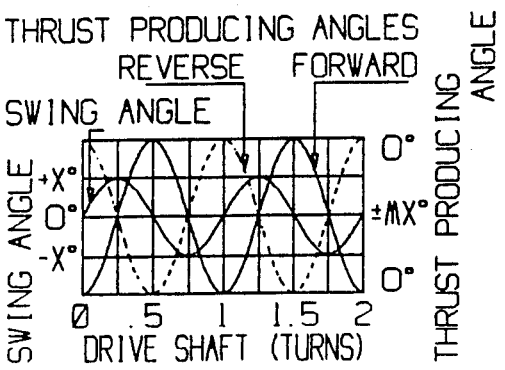
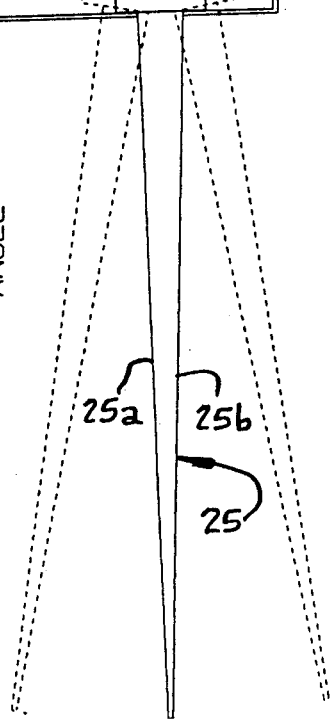
Fig. 15.

248
250
244
245
246
249
242
247
132
135
131
54
55
243
62
125
56
64
175
176
59
58
127
61
60
32
40
34
33
51
22
21
44
63
39
260
241a
57
43
241b
C
241
B

THRUST IS FORWARD
THRUST IS BACKWARD
ARROWS INDICATE SWING

BOAT PROPULSION APPARATUS

BACKGROUND OF THE INVENTION

The present invention relates to improvements in the boat propulsion apparatus disclosed in the applicant's prior U.S. Pat. No. 4,490,119 and in which a thrust blade is mounted on a swing frame for swinging movement therewith about a swing axis extending generally longitudinally of the boat, and for turning movement relative to the swing frame about a generally upright blade axis, and drive means angularly oscillates the swing frame about the swing axis to swing the thrust blade in a direction crosswise of the boat and angularly oscillates the thrust blade about the blade axis in timed relation with the angular oscillation of the swing frame.

As disclosed in the above patent, the drive means included a swash plate, the angle of which was varied by a screw and nut operated by a trigger mechanism that engaged and rotated a star wheel fixed to the orbiting nut. Clockwise or counterclockwise rotation of a nut through a preselected angle for each revolution of the swash plate was achieved by one toe or the other of the trigger. In operation, this mechanism had some disadvantages arising from the uncontrolled force of the blow transmitted to the star wheel by the trigger, especially at high speeds when the force of the blow is greatest. It was found that the star wheel could be struck so hard that a free running nut may be rotated more than the desired angle and put it out of phase with the adjusting nut on the other swash plate of a dual drive. Another problem can arise from overtightening of the nut at either end of its travel because, if the overtightening occurs at high speed, and the speed is reduced prior to attempting to reverse the nut's direction, the force to take the nut off the stop is reduced and may be ineffective.

In the prior boat propulsion apparatus, the swing frame had upper and lower arms which served the dual functions of providing support bearings for the swash plate assembly and support bearings for the blade shaft which projected down through the lower arm of the swing frame. Because the forces applied to the swing frame by the swash plate are opposed to, and act in a different plane from, the forces resisting the transverse motion of the thrust blade by way of the blade shaft, the swing frame was subjected to a force couple which produced particularly high stresses at the rear corners of the swing frame where the blade shaft bearings were located. The effect of these stresses is magnified by the reversal of forces which takes place every machine cycle. In addition, the prior arrangement in which the blade shaft extended downwardly through the lower arm of the swing frame, made it difficult to enclose and seal the drive mechanism against the entrance of water. The prior design made it necessary to provide slots in the bottom of the housing through which the blade shafts passed, and these slots in the housing are barely above the water line and are difficult to seal because of the combined swinging and semi-rotating motion of the blade shafts. The seal provided also tended to dip into the water and create an unwanted drag, which was detrimental to the unit's efficiency and added to resistance to boat motion.

The boat propulsion apparatus disclosed in the above patent also made no provision to protect the blades from damage such as would be caused by accidental contact of the thrust blades with shoals or debris in the water. Such damage could be severe enough to require replacement of the blade and this would be a major operation difficult to carry out on the water.

In order to adjust the angle of the swash plate the swash plate must be pivoted for movement about an axis generally radially of the drive shaft. In the prior apparatus disclosed in the above patent, the swash plate was supported by two pivot pins adjacent the center of the swash plate and it was found that they did not provide enough support to maintain the swash plate rigidly on the center line of the pivot pins under heavy load. This allowed the assembly to flex and vibrate and deform under heavy load.

SUMMARY OF THE INVENTION

The present invention relates to boat propulsion apparatus of the type having a swing frame mounted on a support structure for swinging movement about a generally horizontal swing axis and a thrust blade mounted on the swing frame for swinging movement therewith about the swing axis and for turning movement relative to the swing frame about a generally upright blade axis, and drive means for angularly oscillating the swing frame about the swing axis to swing the thrust blade in a direction crosswise of the boat and for angularly oscillating the thrust blade about the blade axis in timed relation with the angular oscillation of the swing frame.

It is an object of the present invention to provide an improved mechanism for adjusting the angle of the swash plate of the drive, by utilizing a planetary gear system by means of which the angle of the swash plate can be varied throughout its range in a smooth stepless manner.

Another object of this invention is to provide a boat propulsion apparatus of the type described having a swash plate drive and an improved arrangement for mounting the swash plate for angular adjustment relative to the drive shaft to reduce vibration and decrease stresses in the swash plate mount.

Another object of this invention is to provide a boat propulsion apparatus of the type described having an improved swing frame construction and arrangement for mounting the thrust blade on the swing frame and which reduces stresses in the swing frame during operation of the boat propulsion apparatus.

Another object of this invention is to provide a boat propulsion apparatus of the type described, which enables the use of a simpler, more efficient seal located substantially above the bottom of the drive mechanism where it is less exposed to water and where the seal does not interfere with water flow or create drag.

Another object of this invention is to provide a boat propulsion apparatus of the type described, and having an overload release coupling between the blade shaft and thrust blade, to minimize damage in the event the thrust blade engages an obstruction.

A further object of this invention is to provide a boat propulsion apparatus in accordance with the foregoing object and in which the overload release coupling can be readily reset without removing the boat propulsion from the boat.

BRIEF DESCRIPTION OF THE DRAWINGS

FIG. 3 is a view from the rear of the boat propulsion apparatus taken on the plane 3—3 of FIG. 2;

FIG. 15 is a graph illustrating the blade swing angle and the blade thrust producing angle in forward and reverse, at different angular positions of the drive shaft;

DETAILED DESCRIPTION

Figures 1, 14:
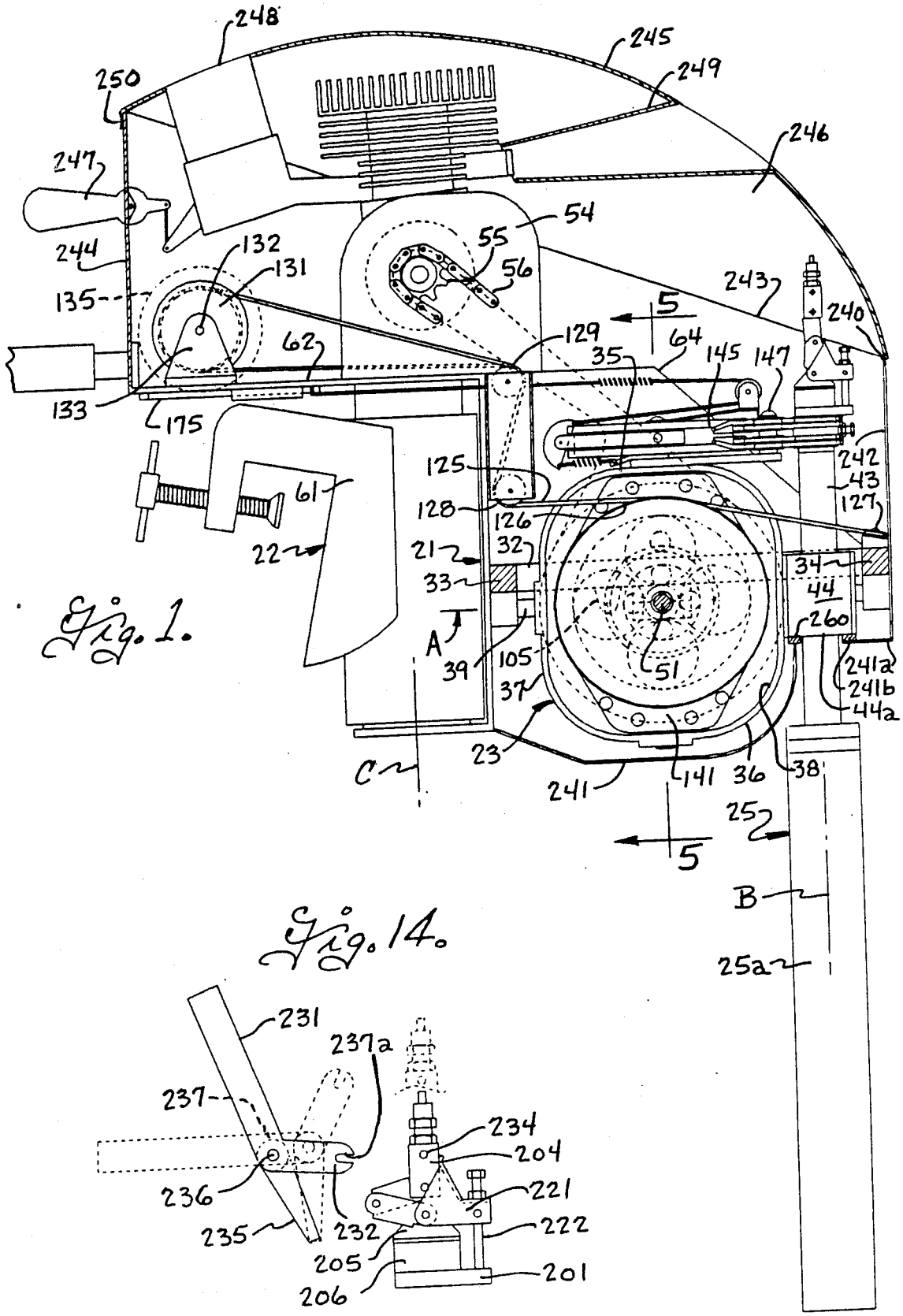
FIG. 1 is a side view of the boat propulsion apparatus, with parts of the housing cut away.
FIG. 14 is a side view of the thrust blade release control mechanism, illustrating the release control in a folded condition and a reset wrench for resetting the release control mechanism.

The present invention relates to improvements in boat propulsion apparatus of the type disclosed in my prior U.S. Pat. No. 4,490,119, the disclosure of which is incorporated herein by reference. The boat propulsion apparatus is adapted for use on various different types of boats and may, for example, be arranged for mounting on the transom of a boat, outboard of the hull for operation as an outboard propulsion apparatus. Alternatively, the boat propulsion apparatus can be mounted inside the hull with only the thrust blades extending externally of the hull for operating as an inboard propulsion apparatus. The boat propulsion apparatus can be the sole means for propelling the boat or, alternatively, can provide an auxiliary power system for sail boats and the like.

The boat propulsion apparatus in general includes a support structure 21, a means 22 for mounting the support structure on a boat, at least one and preferably an even number of thrust blades 25. The thrust blades are each mounted on a swing frame designated 23 that is mounted on the support structure for swinging movement about a generally horizontal swing axis A extending lengthwise of the boat, and at least one thrust blade 25 is mounted on each swing frame for swinging movement therewith about the swing axis and for turning movement relative to the associated swing frame about a generally upright blade axis B. The thrust blade extends downwardly from the swing frame and has thrust surfaces **25*a* and 25*b*** at relatively opposite sides. A swash plate drive mechanism is provided for angularly oscillating each swinging frame about the swing axis A to swing the associated thrust blades in a direction crosswise of the boat, and for simultaneously angularly oscillating the thrust blades about their generally upright blade axis B in timed relation with the angular oscillation of the swing frame. The thrust blades and the drives therefore are of like construction, and like numerals are used to designate the same parts of the thrust blades and swash plate drives.

In the embodiment shown, the support structure 21 includes a rigid support frame having outer and intermediate support frame members 31 and 32 extending generally lengthwise of the boat, and forward and rear crossframe members 33 and 34 extending crosswise of the boat and rigidly interconnecting the outer and intermediate frame members. The swing frames 23 are in the form of a rigid generally rectangular frame having upper and lower sides 35 and 36 and forward and rear sides 37 and 38. The swing frames are each pivotally mounted by forward and rear pivot pins and bearings 39, 40 on the cross frame members for swinging movement about the swing axis A extending lengthwise of the boat. The thrust blades 25 each have a blade shaft 41 (FIG. 6) connected to its upper end and rotatably mounted on a respective one of the swing frames for rotation about the generally upright blade axis B. Thus, the blades 25 are supported on the swing frame for swinging movement therewith about the swing axis A in a direction crosswise of the boat, and also for turning movement relative to the associated swing frame about the generally upright blade axis B.

In accordance with one aspect of the present invention, there is provided an improved arrangement for mounting the thrust blade shaft on the swing frame, and which reduces stresses in the swing frame and also facilitates enclosing the propulsion apparatus to inhibit entrance of water. As best shown in FIGS. 1, 6, 9 and 10, a rigid blade shaft housing tube 43 is rigidly mounted by a tube mounting head 44 on the swing frame, with the tube disposed externally of the swing frame at the rear side 38 thereof. The mounting head 44 is interposed between the rear side 38 of the swing frame and the rear swing pivot 40, and the rear swing pivot is secured to the drive head in any suitable manner as by fasteners 45. The shaft housing tube 43 is disposed generally parallel to a plane through the swing frame and perpendicular to the swing axis, and the blade shaft 41 is rotatably supported in the shaft housing tube as by upper and lower bearings 46 (see FIG. 10). For reasons pointed out more fully hereinafter, the tube mounting head 44 is provided with a surface **44*a* at its underside that is generally concentric with the swing axis A defined by the forward and rear swing pivots 39 and 40**.

Figures 4, 16, 17:
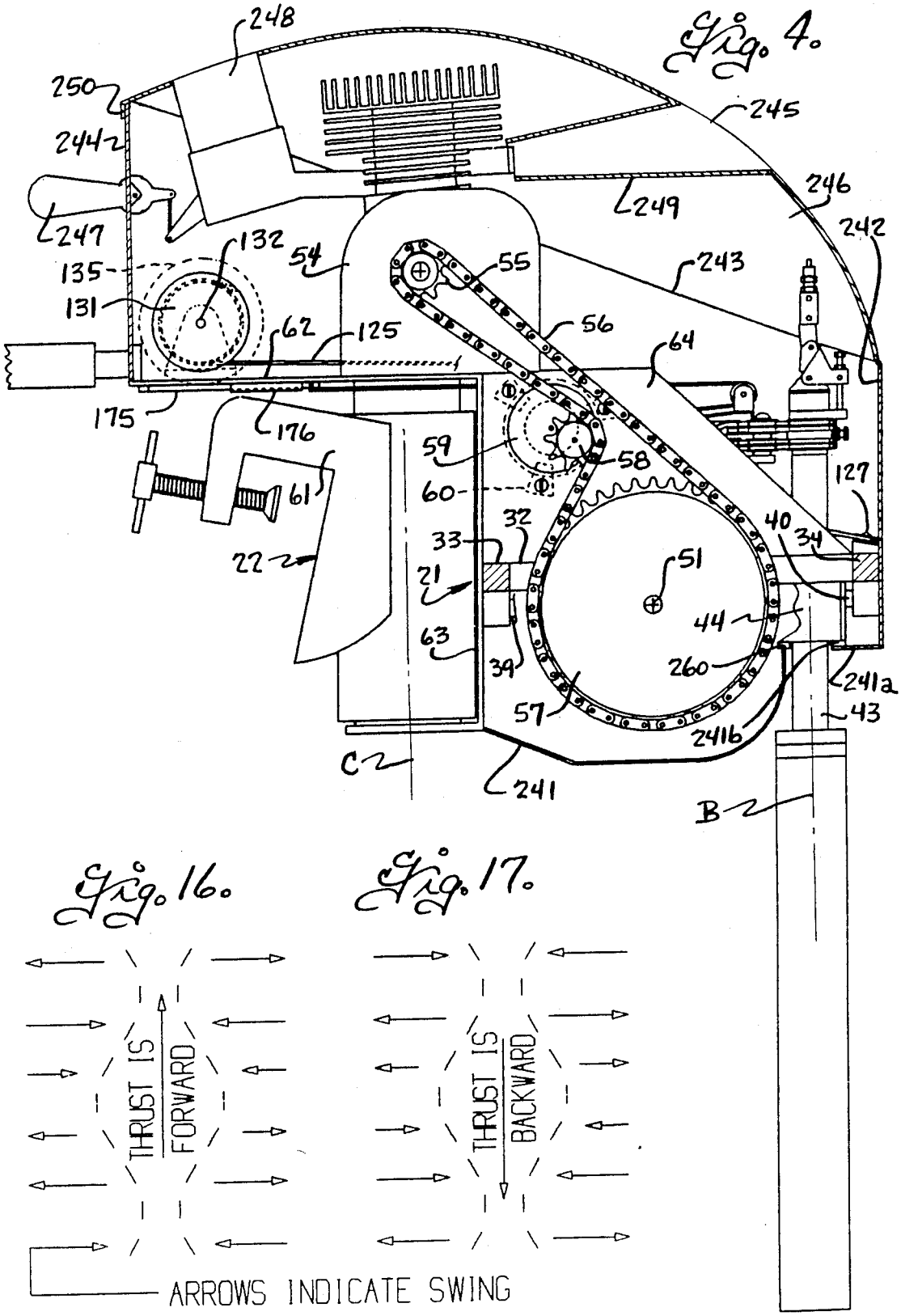
FIG. 4 is a longitudinal vertical sectional view through the boat propulsion apparatus taken on the plane 4—4 of FIG. 3.
FIG. 16 is a diagrammatic plan view relating the changes in thrust producing angle of a pair of oppositely phased thrust blades to the crosswise swing of the thrust blades when in the forward drive mode.
FIG. 17 is a diagrammatic plan view relating the change in thrust producing angle of a pair of oppositely phased thrust blades to the lateral swing of the thrust blades when in the reverse drive mode.

The drive mechanism includes a generally horizontal drive shaft 51 that extends crosswise of the boat and is rotatably supported by suitable bearings 52 on the outer and intermediate frame members 31 and 32. The drive shaft is driven by a motor 54 and, as best shown in FIG. 4, a drive sprocket 55 on the motor shaft is connected through a chain 56 to a driven sprocket 57 on the drive shaft 51. An idler sprocket 58 is supported for rotation on a mounting base 59 and the base is adjustable to enable adjustment of the chain tension. As shown, the sprocket mounting base has a circular configuration with the idler sprocket 58 located eccentrically on the base, and the base is adapted to be clamped in angulary adjusted position as by clamps 60.

In the embodiment illustrated, the boat propulsion apparatus is of the outboard type and the mounting means 22 includes a transom clamp 61 for mounting the apparatus on the rear transom of a boat. The support structure also includes a generally horizontal motor platform 62, a transverse bulkhead 63 and longitudinal bulkheads 64 that are rigidly interconnected to each other and to the support frame 21. The support structure is mounted on the transom clamp 61 for movement relative thereto about a generally upright steering axis C. The motor 54, which may be of the internal combustion type or electric type, is usually quite heavy and is advantageously positioned on the motor base 62 directly over the steering axis C so that the propulsion apparatus is not heavily overbalanced rearwardly of the boat. This provides improved steering control and facilitates operation of the boat propulsion apparatus.

Figure 7:
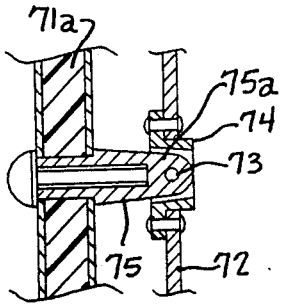
FIG. 7 is a fragmentary sectional view taken on the plane 7—7 of FIG. 6.
Figure 5:
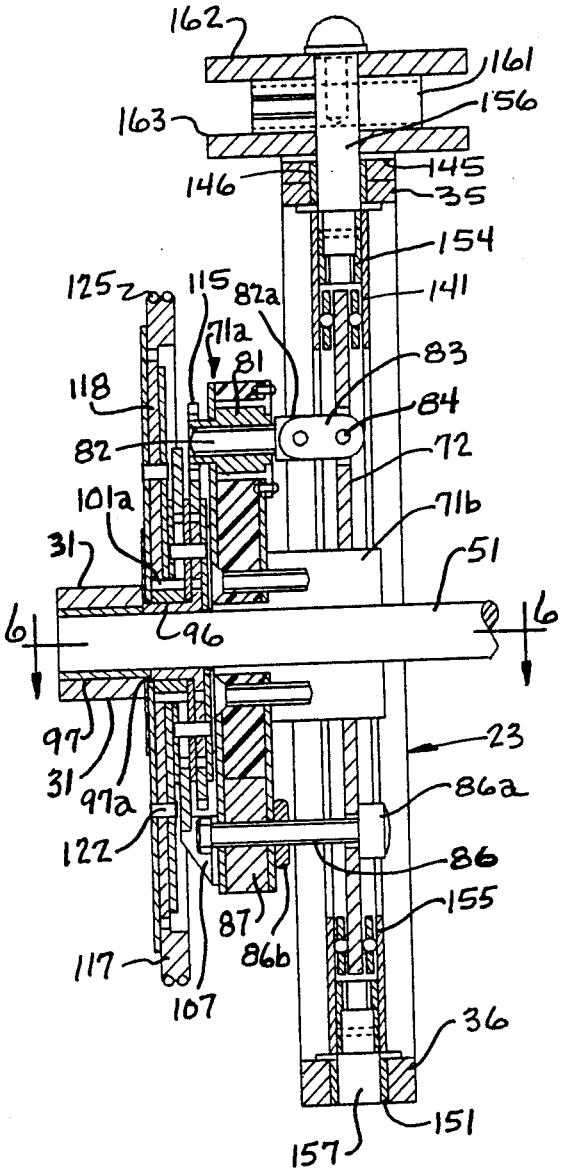
FIG. 5 is a fragmentary vertical sectional view through the adjustable swash plate drive taken on the plane 5—5 of FIG. 1 and illustrating parts on a larger scale than FIG. 1.
Figure 6:
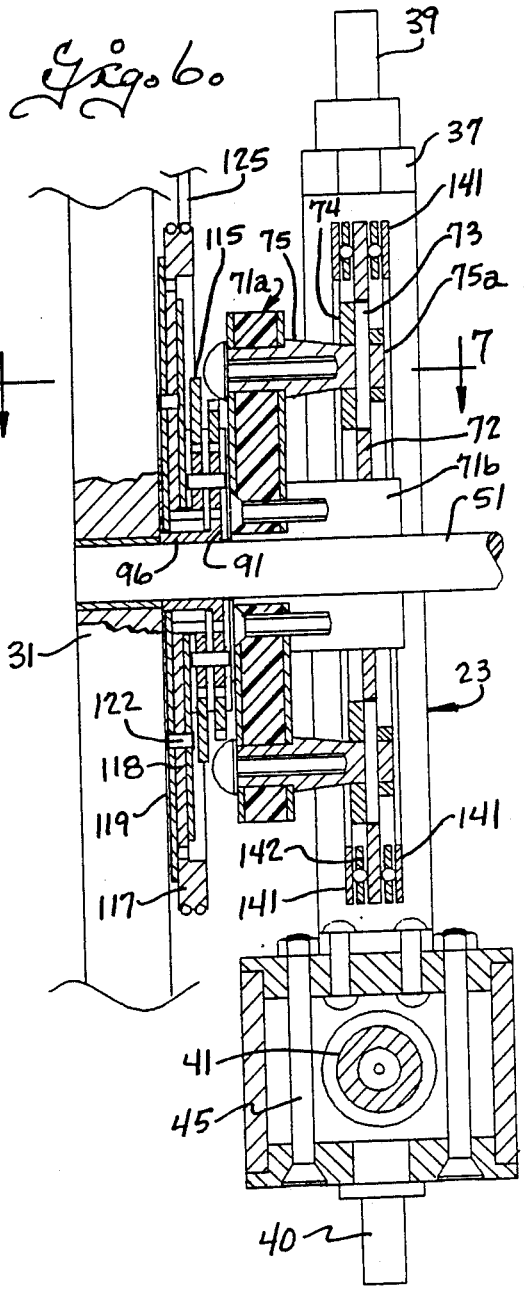
FIG. 6 is a fragmentary horizontal sectional view taken on the plane 6—6 of FIG. 5.

A swash plate drive is provided for oscillating each of the swing frames and the thrust blade associated therewith. In accordance with another aspect of the present invention, there is provided an improved arrangement for mounting the swash plate and for adjusting the angle of the swash plate relative to the drive shaft 51. As best shown in FIGS. 5–7, each swash plate drive includes a drive head having a disk portion **71*a* and a hub portion 71*b* fixed to the drive shaft 51 for rotation therewith. A swash plate 72 is provided with a central opening dimensioned to loosely receive the hub portion 71*b* of the drive head and is supported by pivot pins 73 for tilting movement about an axis extending radially of the drive shaft. The disk portion 71*a* of the drive head is conveniently a composite disk laminated from two steel outside plates with a light weight plastic core. In the preferred embodiment illustrated, the pivot pins 73 are mounted by flanged inserts 74 on the swash plate at a location spaced outwardly of the hub receiving opening and adjacent its outer periphery. Posts 75 are fixed to the disk portion 71*a* of the drive head at diametrically opposite locations spaced outwardly from the hub portion 71*b* and the posts extend laterally from the disk portion and have end portions 75*a*, that extend into the inserts 74 and which are pivotally mounted on the pins 73. The posts 75 and the pivot pins 73 rotate the swash plate with the drive head and drive shaft 51**, but allow the swash plate to tilt angularly relative to the shaft, from a neutral position perpendicular to the drive shaft as shown in the drawings.

An adjustable means is provided for interconnecting the drive head and the swash plate to adjust the angle of the swash plate. The adjustable means includes a rotary adjusting member 81 mounted on the disk portion **71*a* of the drive head for rotation relative thereto about an axis parallel to and spaced radially outwardly from the drive shaft 51. As shown in FIG. 5, the rotary adjusting means is of the nut and screw type in which the rotary adjusting member 81 threadedly engages a screw 82 that engages the swash plate 72 at a location angularly spaced 90° from the swash plate pivots 73. The screw 82 has a flattened head portion 82*a* that is non-rotatably connected by a trunion block 83 to a pin 84 attached to the swash plate to effect adjustment of the angle of the swash plate in response to rotation of the rotatable adjusting member 81 relative to the drive head. Stop means are provided to limit the maximum angle of adjustment of the swash plate. As best shown in FIG. 5, a headed bolt 86 is mounted on the disk portion of the drive head at a location diametrically opposite to the rotatable member 81. As shown in FIG. 5, the bolt 86 extends through a radially elongated opening in the swash plate and has a head 86*a* at its outer end arranged to engage the swash plate and limit tilting of the swash plate in one direction. The bolt is threadedly mounted in a counterweight 87 embedded in the disk portion of the drive head for rotation with the drive head. The bolt 86 and trunion block 83 drive the swash plate with the drive head while accommodating angular tilting of the swash plate. A resilient abutment 86*b* is provided on drive head adjacent the bolt 86 at the side of the swash plate opposite the head 86*a***, to limit angular tilting of the swash plate from the neutral position shown.

Figure 8:
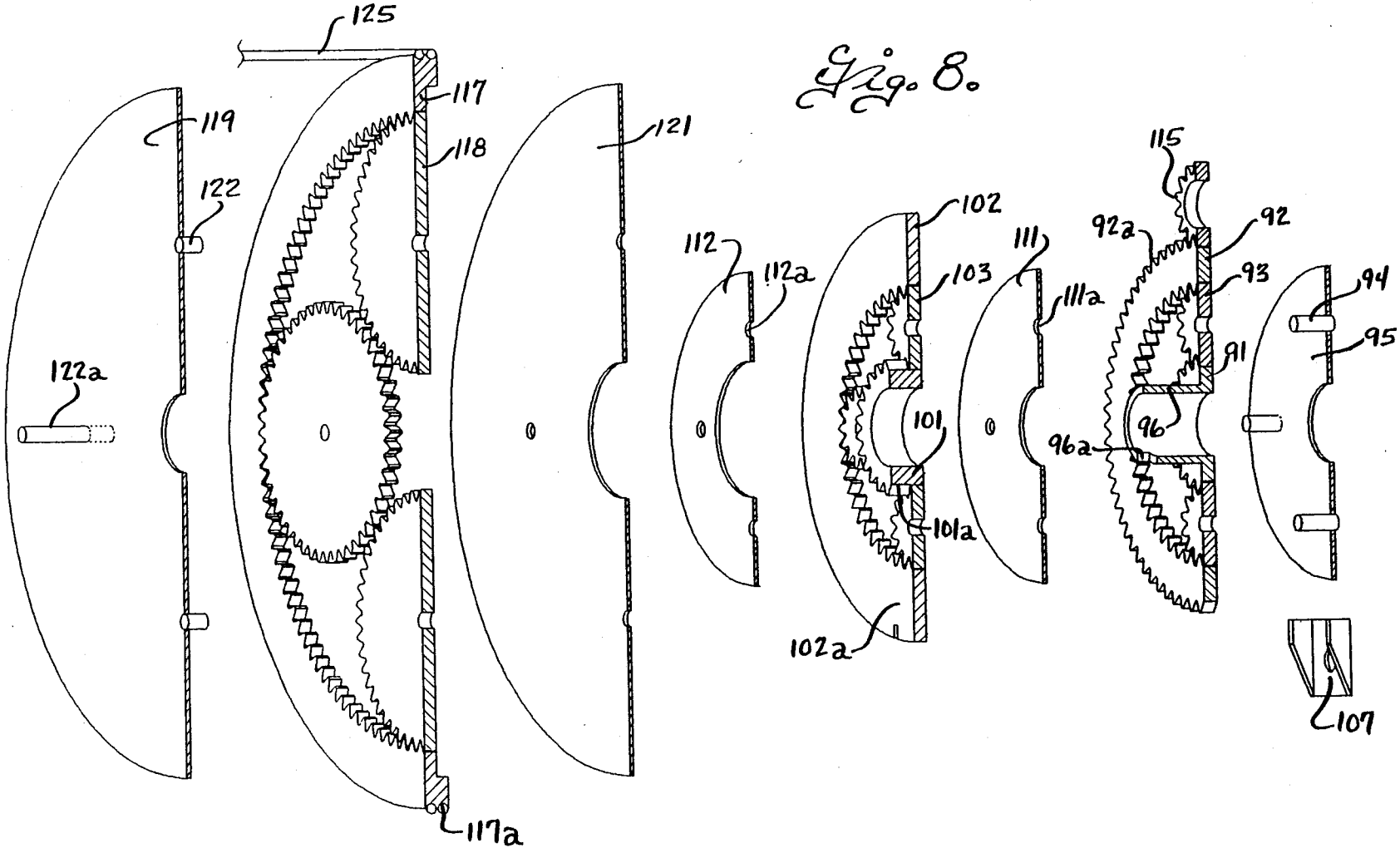
FIG. 8 is an exploded isometric view of the planetary gear swash plate adjusting mechanism.

In accordance with another aspect of the present invention, a planetary gear control mechanism is provided for rotating the rotatable member 81 relative to the drive head, to adjust the angle of the swash plate. The planetary gear mechanism is best shown in FIGS. 5, 6 and 8 and comprises a first planetary gear set including a first sun gear 91, a first ring gear 92 and a plurality of planet gears 93 in meshing engagement with the sun gear 91 and ring gear 92. The planet gears 93 are rotatably supported by pintles 94 on a planet carrier 95. The sun gear 91 rotatably receives the drive shaft 51 to allow rotation of the drive shaft relative thereto, and the sun gear itself is held against rotation. The sun gear 91 is formed integrally with or fixed to a hub 96 having a notch **96*a* in its outer end, and which engages a tongue 97*a* on a shaft support bearing 97 fixed to the support frame member 31 (see FIG. 5). The planetary gear mechanism also includes a second planetary gear set including a second sun gear 101, a second ring gear 102 and a plurality of planet gears 103 in meshing engagement with the sun and ring gears 101 and 102. The second sun gear 101 is rotatably supported on the hub 96, and the second ring gear 102 is rotated with the drive shaft 51 by a bracket 107 fixed to the drive head and which engages notches 102*a*, in the ring gear 102, as best shown in FIGS. 5 and 8. A disk 111 is disposed between the first and second planetary gear sets and a disk 112 is disposed at the outer side of the second planetary gear set and the pintles 94 on the carrier 95 extend through the planet gears 93 and through holes 111*a* in disk 111 and through the second planetary gears 103 and into holes 112*a*, on the disk 112 to provide alignment of the two planetary gear sets and keep the planet gears 93 and 103 abreast of each other in paired sets. The pintles 94 are caulked into disk 112 to hold the assembly together. The planet carrier 94 and pintles 95 together with disks 111 and 112 thus form a planet carrier means for rotatably supporting the planet gears of the first and second sets for orbital movement in unison. With this arrangement, the second ring gear 102 is driven at the same speed as the drive head and, when the second sun gear 101 is held stationary, the planet gears 103 and 93 will orbit together and rotate the first ring gear 92 at the same speed as the drive head. The first ring gear 92 is drivingly connected to the rotatable adjusting member 81 and, as best shown in FIG. 8, the ring gear 92 has external gear teeth 92*a*, that mesh with a pinion gear 115 fixed to the rotatable member 81. Thus, the rotatable member 81 will be rotated about its axis through a number of turns and in a direction correlative with the angular movement of the first ring gear 91** relative to the drive head.

Manually operable means are provided for rotating the second sun gear 101. In the preferred embodiment illustrated, this includes a third planetary gear set having a third ring gear 117, and a third set of planetary gears 118 that mesh with the third ring gear and with a sun gear 101*a* fixed to or formed integrally with the second sun gear 101. Disks 119 and 121 are disposed on opposite sides of the third gear set and planet carrier pins 122 are mounted on the disks 121 and extend through the planet gears 118 to rotatably support the same. The planet carrier means 119, 121 is held against rotation with the drive shaft and, conveniently, one of the planet carrier pins 122*a* is extended at the outer side of the disk 119 to project into an opening in a bracket 105 fixed to an outer frame member 31 of the support frame (see FIG. 1). Thus, turning of the third ring gear 117 will rotate sun gears 101*a*, 101 to angularly adjust the swash plate.

Each ring gear 117 is formed with dual grooves 117*a*, on their outer periphery to receive a control cable 125 which is overlapped on the ring gear 117 and secured at a location indicated at 126 in FIG. 1 to the ring gear. The cable is routed rearward intermediate its ends by way of pulleys 127 (see FIG. 2) mounted adjacent the rear end of the support frame, from the ring gear on one swash plate drive to the ring gear on the other swash plate drive. The cable 125 is routed forward from the ring gear 117 on each swash plate drive over pulleys 128 and 129, to control pulleys 131 mounted on a shaft 132 carried on brackets 133 adjacent the forward side of the boat propulsion apparatus. A hand wheel 135 is mounted on each end of the shaft 132 to enable the operator to activate the control system from either side, and the ends of the cable 125 are wound in relatively opposite directions on the control pulleys 131 for the dual drive so that manual rotation of either hand wheel in one direction rotates both ring gears in a clockwise direction when viewed from the respective side. Rotation of the pulleys 131 in the opposite direction turns the ring gears 117 counterclockwise. The location 126 at which the cables 125 are attached to the ring gears is selected such that it will allow the ring gears 117 to be rotated over approximately three-quarters of a revolution. The cable is tightened by loosening the set screw holding one of the pulleys 131 to the shaft 132, rotating it manually counter to the pulley 131 on the other end of the shaft, and tightening the set screw. As is apparent, the pulleys 131 could be arranged for operation independent of each other, if it is desired to provide individual control of the pitch of each thrust blade.

When the machine is not operating, rotation of the ring gears 117 by the control cable 125 will rotate the planets 118 whose axles are held in a fixed position by the stop pin 122*a*. The rotating planets 118 in turn rotate the sun gears 101*a*, 101 and the planets 103 on the second planetary gear set. Since the ring gear 102 of the second planet gear set is prevented from rotating relative to the drive head by the bracket 107, the planet 103 will roll around the inside of the ring gear 102 and drive the planet carrier 95 around the axis of the drive shaft relative to the ring gear 102. The planet carrier 95 will thus drive the planet gears 93 around the fixed sun gear 91 of the first planetary gear set and, in doing so will rotate the ring gear 92, which rotates the pinion gear 115 and the rotary adjusting member 81 to change the angle of the swash plate. The net effect of rotating the control ring gear 117 is a differential rotation of ring gears 102 and 92, whether the machine is running or not.

When the machine is running at machine speed with the control ring gears 117 in any one position, the rive head 71*a*, 71*b* drives the ring gears 102 about the axis of the drive shaft. Ring gear 102 drives the planets 103 about the sun gear 101 which is held from rotating by the planets 118 and the cables anchored to the control ring gear 117. Since the sun gear 91 is also held from rotating, and the planet gears 103 and 93 are coupled together, then the ring gear 92 will also revolve around the axis of the drive shaft at machine speed with the drive head. The pinion gear 115 will orbit with the drive head and ring gear 92, but will not revolve on its axis.

When the control cable 125 is operated with the machine running, the speed differential produced between the two ring gears 102 and 92 will rotate the pinion gear 115 and the rotary adjusting member 81 in the same manner that it will with the machine at rest. This enables the angle of the swash plates to be changed smoothly and synchronously by any desired positive or negative increment at all machine speeds. The gear sizes are arranged so that rotation of the control ring gear 117 by three-quarters of a turn, will rotate the rotary adjusting member 81 a sufficient number of times to vary the swash plate angle by the required amount. A ratio of 1:11 has been found satisfactory.

Each swing frame 23 forms a closed hoop frame that carries the bearing plates 141 and ball races 142 (see FIGS. 5 and 6) that transmit motion from the swash plate to the swing frame and the blade pitch control system. A member 145 is rigidly attached to the upper side 35 of each swing frame for additional support of an upper bearing 146, and the member 145 is extended to the rear of the swing frame to provide a mounting for a pin 147 (see FIG. 13) carrying idler pulleys 148 and 149. The lower side 36 of the swing frame is thickened adjacent the center to carry a lower bearing 151.

The bearing plates 141 are disposed at opposite sides of the swash plate and enclose the ball races 142. The bearing plates are interconnected at their upper and lower ends by upper and lower followers 154 and 155 having pintles 156 and 157 that are rotatably supported in bearings in the upper and lower sides 35 and 36 of the associated swing frame, for turning about an axis extending generally radially of the associated swash plate. As disclosed more fully in the aforementioned U.S. Pat. No. 4,490,119, the plates 141 have inwardly extending lugs (not shown) arranged to engage the inner periphery of an adjacent one of the bearing retainers to maintain the bearing retainers centered with respect to the drive shaft while allowing the bearing retainers to rotate relative to the bearing plates. Thus, when the swash plates are disposed at an angle to the drive shaft 51 and the drive shaft is rotated, the swash plate imparts a swing motion to the swing frames about the swing axis A and also imparts an angular oscillation motion of the follower members 154, 155 and the associated pintles 156, 157, about the axis of the pintles and generally radially of the swash plate.

Figure 2:
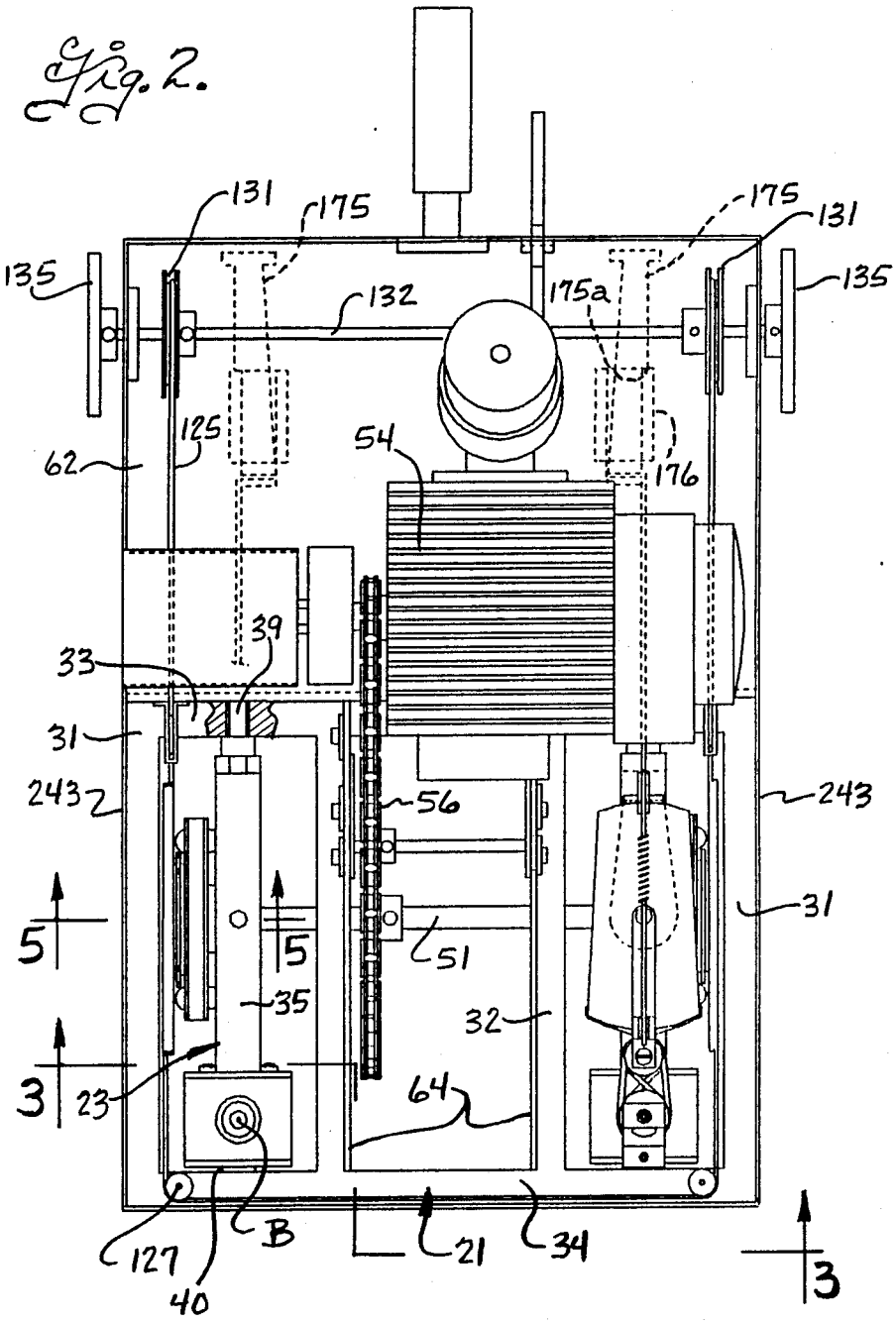
FIG. 2 is a plan view of the boat propulsion apparatus, with parts to the housing and one motion conversion mechanism and blade release cut away.
Figure 13:
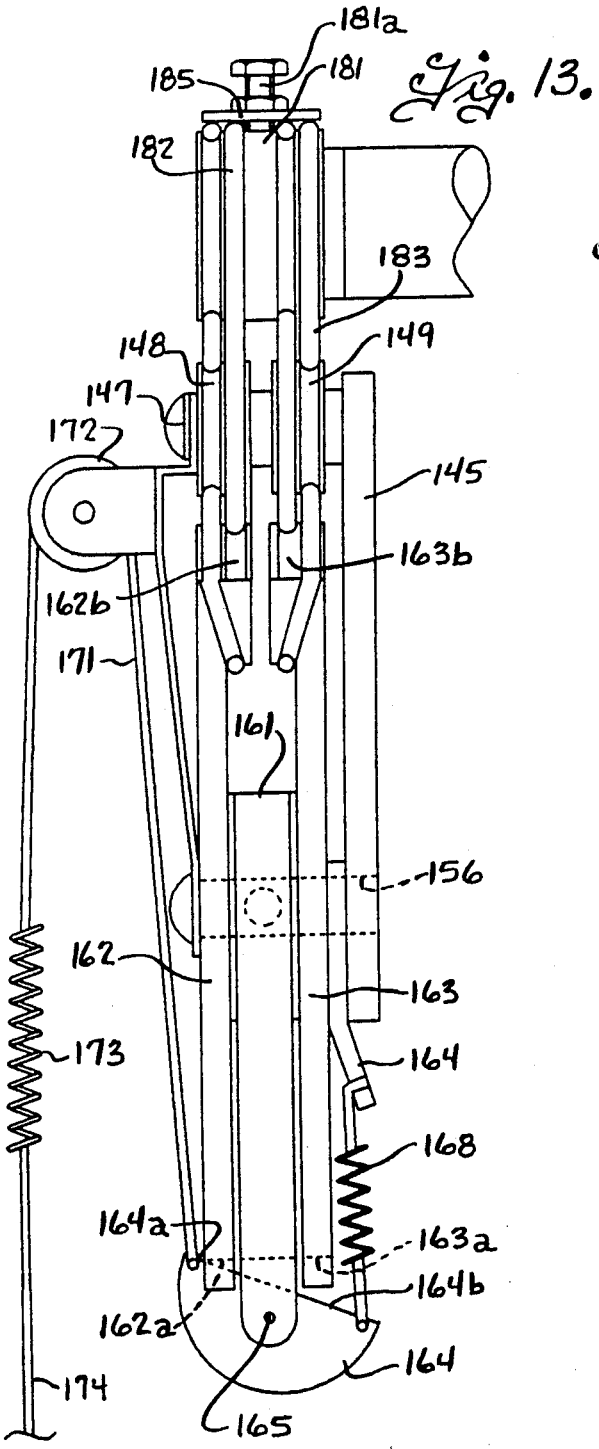
FIG. 13 is a side view of the motion conversion mechanism of FIG. 12.
Figure 12:
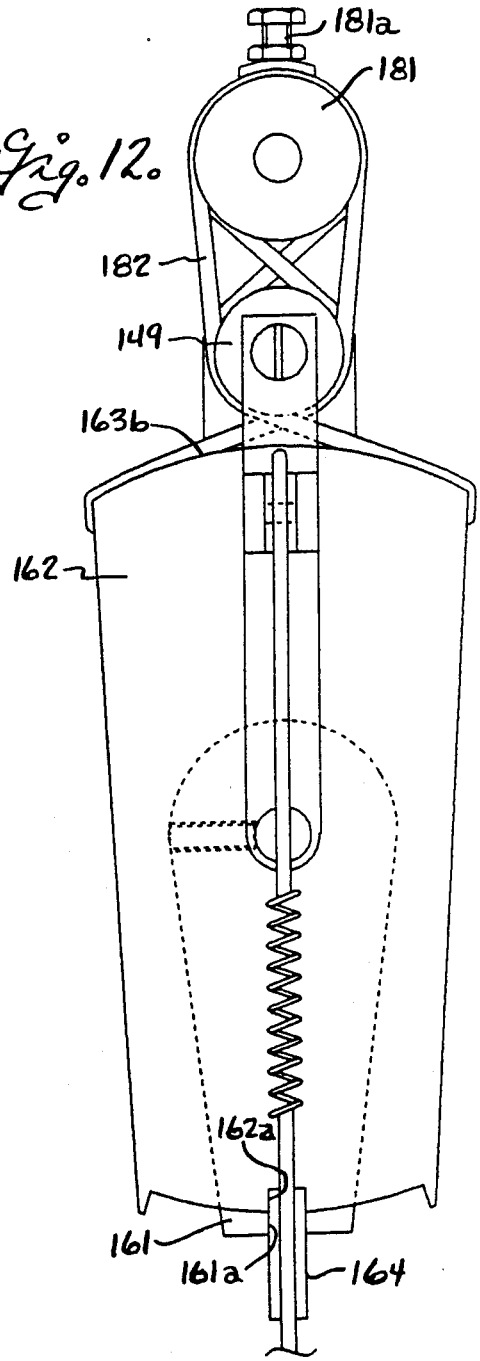
FIG. 12 is a plan view of one of the motion conversion mechanisms shown in FIG. 2 and illustrating parts on a larger scale than FIG. 2.

The upper follower 154 is connected to the associated thrust blade to oscillate the thrust blade in response to angular oscillation of the follower. As disclosed in the aforementioned patent, the connecting means advantageously includes a motion amplifying means to increase the angular motion of the thrust blade relative to the angular motion of the follower, and means for reversing the direction of rotation of the thrust blade relative to the direction of angular oscillation of the follower to enable the boat propulsion apparatus to be used for both forward and reverse drive. For this purpose, a drive member 161 is non-rotatably connected as by a set screw to the pintle 156, for turning with the upper follower member 154. Forward and reverse drive segments 162 and 163 are rotatably mounted on the upper pintle 156 for turning movement relative thereto and relative to the drive member 161, and a clutch member 164 is provided for selectively connecting the drive member 161 to either forward drive segment 162 or the reverse drive segment 163. The clutch member 164 is disposed in a slot 161*a* in the drive member 161 and is pivotally supported thereon by a pin 165 for pivotal movement in an upright plane relative to the drive member. The clutch member 164 has nose portions 164*a*, and 164*b* respectively adapted to cooperate with slots 162*a*, and 163*a* in the forward and rear drive segments. The clutch member can be moved from a neutral position out of engagement with the forward and rear drive segments, selectively to a forward position as shown in FIGS. 12 and 13 in which the upper nose portion 164*a* extends into the slot 162*a* in the forward drive segment, to reverse position in which the lower nose portion 164*b*, extends into the slot 163*a* in the reverse drive segment 163. The clutch is yieldably biased by a spring 168 attached to a spring anchor 169 that can swing about the pintle 156 in a direction to move the nose portion 164*b* into the slot 163*a* in the reverse drive segment 163. As best shown in FIG. 13, the clutch members 164 for each swash plate drive are connected by a cable 171 entrained over a pulley 172 and a spring 173 to a control cable 174. The control cable 174 extends through the transverse bulkhead 63 and is secured to a control lever 175 (see FIG. 2) which slides in a housing 176 fixed to the underside of the motor platform. The control lever has means which forms a latch 175*a* arranged to engage the housing 176 when the control lever is pulled forwardly and laterally tilted or cocked relative to the housing as shown in FIG. 2, to lock the lever against the pull of spring 173 in the forward drive mode. Separate control levers 175 provide independent hand controls for reversing the direction of thrust for each blade.

A grooved pulley 181 is attached to the upper end of each blade shaft 41 and the idler pulleys 148 and 149 are mounted by the pin 147 at a location intermediate the drive segments and the pulley 181. As best shown in FIG. 12, the drive segments 162 and 163 have arcuate end faces 162*b* and 163*b* respectively generally concentric with the pintle 156 and cable receiving grooves in the arcuate end faces. An upper flexible belt or cable 182 is looped around the blade pulley 181 and idler pulley 148 and then crosses at a location intermediate the idler 148 and the forward drive segment 162 to extend in opposite directions across the grooved face of the forward drive segment, with the ends of the cable 182 resiliently interconnected to maintain the cable under tension. A second cable 183 is looped around the blade pulley 181 and then crosses once at a location intermediate the blade pulley 181 and the idler pulley 149 and then recrosses at a location intermediate the idler pulley 149 and the reverse drive segment 163 to extend across the grooved face of the reverse drive segment with the ends of the cable resiliently interconnected to maintain the cable under tension. The blade pulley 181 has a pair of vertically spaced upper grooves for receiving the cable 182 and the cable is passed from one groove to the other at a location adjacent a cable clamp 185 to prevent the cables from rubbing against each other at the point where they cross adjacent the forward drive segment. Similarly, the blade pulley 181 has a pair of vertically spaced lower grooves and the cable 183 is passed from one groove to the other adjacent the cable clamp 185 so that the runs of the cable 182 do not rub at the location where they cross each other. The pulley 181 is non-rotatably connected to the blade shaft so that the thrust blade will be angularly oscillated about the blade axis B in one phase relation to the angular oscillation of the drive member 161 when the drive member is connected to the forward drive segment 162, and the thrust blade will be angularly oscillated by the blade axis B in a second phase relation to the angular oscillation of the drive member when the drive member is connected to the reverse drive segment 163, which second phase relation is 180° out of phase with the first mentioned phase relation. This enables a propulsion apparatus to be used to drive the boat in both a forward and reverse direction. The angular oscillation of the thrust blade about the blade axis is preferably made substantially greater than the angular oscillation of follower 154. As shown in FIGS. 12 and 13, the drive segments 162 and 163 have a radius from the pintle 156 which is approximately four times the radius of the blade pulley 181 so that the blade is rotated about its axis through an angle about four times the degree of angular oscillation of the follower 154. The turning of the thrust blades about their blade axis B must be correlated with the swinging movement of the swing frames about the swing axis A so that the medial plane of the thrust blade parallels the lengthwise dimension of the boat at both extremes of the lateral swing of the thrust blades, and the thrust blades are at the maximum angle of rotation at the center of their swing. As previously described, the propulsion apparatus preferably uses an even number of thrust blades and the swash blade drives for the pair of thrust blades are operated 180° out of phase with each other. Thus, the thrust blades in each pair move in relatively opposite directions crosswise of the boat and also turn in relatively opposite directions about their blade axis B, as diagrammatically shown in FIGS. 16 and 17. With this arrangement, the components of thrust in a direction crosswise of the boat are effectively cancelled out and the components of thrust in a direction lengthwise of the boat are in the same direction and are additive. The swing angle of the blades about the swing axis A and the angle of oscillation of the blades about the blade axis B can be adjusted by the planetary gear adjusting mechanism previously described, to vary the mechanical advantage of the drive and, when the swash blade angle is adjusted to zero degrees as shown in the drawings, the drive is in a neutral or no drive mode.

Figure 10:
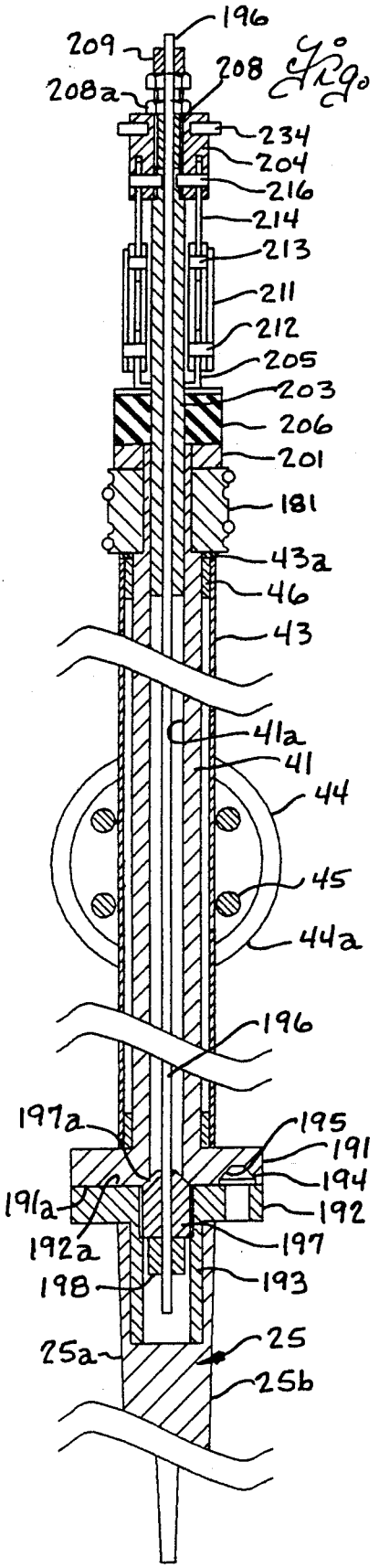
FIG. 10 is a fragmentary vertical sectional view taken on the plane 10—10 of FIG. 9.
Figure 11:
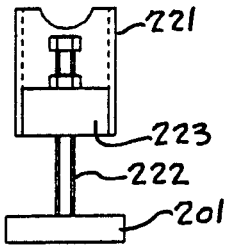
FIG. 11 is a fragmentary view taken on the plane 11—11 of FIG. 9.
Figure 9:
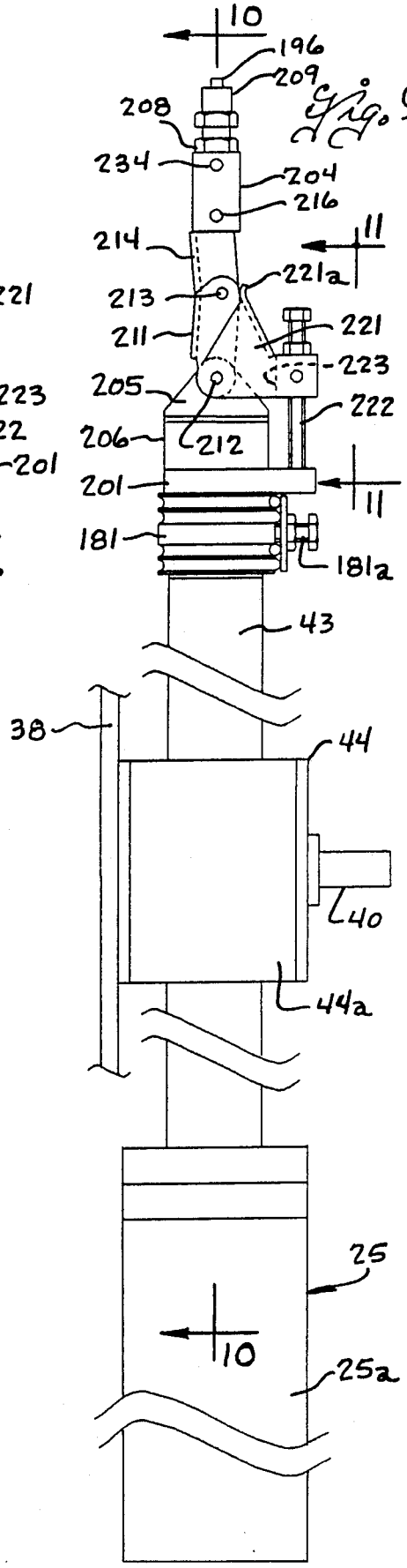
FIG. 9 is a side elevational view of one of the thrust blades illustrating parts on a larger scale than FIG. 1.

In accordance with another aspect of the present invention, an overload release coupling is provided between each thrust blade 25 and its blade shaft 41, to prevent damage to the thrust blade and drive mechanism in the event the thrust blade engages an obstruction such as a shoal or debris in the water. The overload release coupling means is arranged so that the blade will break away from a solid connection with the machine when it strikes an obstruction, but remains attached by a cable, and release control means are provided for each thrust blade to adjust the overload at which the overload release coupling will disengage, and to enable resetting of the thrust blade and overload release coupling. As best shown in FIGS. 9 and 10, the overload release coupling means includes a shaft flange means 191 on the lower end of the blade shaft 41, and a blade flange means 192 provided on an insert 193 fixed to the upper end of the thrust blade 25. The shaft flange means 191 and blade flange means 192 have faces 191*a* and 192*a* respectively disposed transverse to the axis of the blade shaft, and a tapered plug member 194 is provided on one of the flanges such as 192 and arranged to seat in a complementary recess 195 in the other flange to rotate the thrust blade with the blade shaft. The blade shaft 41 has a passage 41*a* extending axially therethrough and a cable 196 is attached at its lower end to the upper end of the thrust blade and extends upwardly through the passage 41*a*. As shown in FIG. 10, a cable stop 198 is fixed to the lower end of the cable 196 and the cable slidably extends upwardly through a hole in a plug 197 that is anchored as by threaded engagement with the blade flange means 192. The plug 197 is advantageously formed with a beveled upper end 197*a* arranged to engage a complementary beveled seat around the lower end of the passage 41*a*, in the blade shaft to aid in centering the blade flange on the shaft flange.

Overload release control means are provided at the upper end of the blade shaft and includes tension applying means connected to the cable 196 for drawing the blade flange means against the shaft flange means to normally drivingly connect the thrust blade to the blade shaft. The overload release control means is operative when the lateral load on the thrust blade exceeds a preselected load to release the tension on the cable and to allow the thrust blade to swing freely on cable 196 relative to the blade shaft. The release control means includes a base pad 201 attached to the blade pulley 181. The pulley 181 is fixed, as by a set screw 181*a*, to the blade shaft and the pulley engages a thrust washer 43*a* on the upper end of the housing tube 43 and is supported thereby against downward movement. The base pad 201, fixed to the pulley 181, is accordingly supported against downward movement relative to the housing and blade shaft. A guide tube 203 is slidably disposed in the upper end of the passage 41*a* in the blade shaft and extends upwardly from the shaft, and a pressure block 204 is mounted as by threaded engagement on the upper end of the guide tube. A base bracket 205 is guidably mounted on the tube 203 in overlying relation to the base pad 201. A resilient pressure pad or spring 206 is interposed between the base pad 201 and the base bracket 205. A stop 209 is removably secured to the upper end of the cable 196 and an adjusting sleeve 208 is adjustably mounted by threaded engagement in the pressure block 204 and locked in adjusted position by a lock nut 208*a*. Toggle joint means are operatively connected to the base bracket 205 and thrust block 204. The toggle joint means includes a lower link 211 pivotally mounted at its lower end by a pin 212 on the base bracket 205, and pivotally connected at its upper end by a pin 213 to an upper link 214 that is pivotally connected by pins 216 to the pressure block. The links 211 and 214 have a channel shaped cross-section and are free to move across the center line of the blade shaft until their webs contact the guide tube 205 with the pivot pin 213 offset slightly to the opposite side of the center line of the blade shaft, to support the toggle joint in an erected condition. The adjusting sleeve 208 is adjusted to tension cable 196 and compresses the pressure pad 206 to an extent sufficient to hold the blade flange means 192 in firm contact with the shaft flange means 191, during normal operation of the boat propulsion apparatus. A trigger 221 is provided for moving the toggle joint means to a folded or collapsed condition, when the lateral load on the thrust blade exceeds a preselected load. As best shown in FIG. 9, the trigger 221 is in the form of a bell crank lever pivotally mounted by the pins 212 on the base bracket. The trigger has a nose portion 221*a* on one leg arranged to engage the toggle joint adjacent its mid point, and at the side opposite the web portions of the links. A screw 222 is threadedly mounted in a block 223 on the other leg of the trigger. The screw 222 is adjusted when the toggle joint is in its erected condition shown in FIG. 9, so as to be closely adjacent the base 201. In the event of overload on the thrust blade occurs, the blade will tend to tilt the blade flange 192 relative to the shaft flange 191 and increase the tension on the cable 196, further compressing the pad 206. Further compression of the pad 206 will bring the adjusting screw 222 into engagement with the base pad 201 and exert upward pressure on the trigger 221. This will cause the trigger to rotate and its upper finger 221*a* will force the junction between the upper and lower links of the toggle joint to the left as viewed in FIG. 9 until the pin 213 passes the center line of the blade shaft. The upper and lower toggle links will then move to a collapsed configuration in which they hinge outwardly and allow the pressure block to move downwardly and produce a slack in the cable 196. When the cable is slack, the thrust blade can swing freely relative to the blade shaft to prevent damage to the blade and drive mechanism. The trigger 221 can be adjusted by means of the adjusting screw 222 to become activated at an overload pressure on the blade which has been previously determined.

To reset the blade after breakaway, the operator lifts the pressure block 204 while guiding the plug 194 into the recess 195 in flange 191, for correct alignment. At this point, the toggle links 211 and 214 can be rotated into their erected or locked condition by a wrench of the typeshown in FIG. 14. As shown, the wrench includes a handle 231 having a pair of laterally extending arms 232 at one end arranged to straddle the pressure block 204, and with slots 237*a* at their free ends adapted to engage pins 234 on the pressure block. Pawls 235 are pivoted to the lever at 236 and arranged to engage the base bracket 205. When the pawls 235 engage the base bracket and the slots 237*a*, engage the pins 234, downward pressure on the handle will lift the pressure block. A roller 237 is provided on the lever and arranged to engage the toggle joints at their juncture to force them over the shaft center line. To facilitate resetting of the thrust blades, the swash plate angle control should be moved to its neutral or no drive position.

The boat propulsion apparatus is provided with an enclosure including a fixed lower housing and a movable cover. The lower housing comprises a bottom 241, a rear wall 242, side walls 243 and front wall 244. The cover is hinged at 240 to the rear wall 242 of the lower housing, and the cover includes a top wall 245 and side walls 246. A latch 250 is provided at the front, to latch the cover in a closed condition. A motor throttle control 247 can conveniently be mounted on the front wall 244 of the housing. Combustion air for the motor 54 is provided through a screened opening 248 and exhaust gases are discharged through a duct 249 built into the top cover. Motor cooling air is drawn in through a duct 251 in the side cover by a fan 252, and is assisted in removal by venturi suction of the exhaust gases through the opening around the loose fitting duct 249 in the top cover.

The mounting of the thrust blade shaft externally of the swing frame with the tube 43 and head 44, facilitates sealing of the enclosure against entrance of water. As best shown in FIG. 1, the bottom wall 241 of the enclosure extends below the swing frame and terminates in a rear portion 241*a* at a level substantially above the bottom of the swing frame. The rear portion 241*a* of the bottom has a slot 241*b* to allow the shaft housing tube 43 to extend downwardly therethrough, and accommodate swinging movement of the housing tube with the swing frame. As previously described, the tube mounting head 44 has an undersurface 44*a* that is concentric with the swing axis, and a simple saddle type seal 260 is provided on the housing and arranged to engage the lower periphery of the mounting head to provide a sliding seal between the enclosure and mounting head around the opening 241*b*.

In the graph of FIG. 15, "X°" is the angle of the swash plate and hence the swing angle. "M" is the angular motion multiplier produced by forward and reverse segments 162 and 163. As will be apparent from FIGS. 15, 16 and 17, the swash plate drive angularly oscillates the swing frame about the swing axis through the blade swing angle X° and angularly oscillates the thrust blade about the blade axis in timed relation with the oscillation of the swing frame through thrust producing angles MX° such that the blade is at a maximum thrust producing angle when the blade is at the center of the swing angle and at zero thrust producing angle when the blade is at either extremity of the blade swing angle.

The embodiments of the invention in which an exclusive property or privilege is claimed are defined as follows:

1. In a boat propulsion apparatus including a support structure adapted for mounting on a boat, at least one swing frame mounted on the support structure for swinging movement relative thereto about a swing axis adapted to extend generally lengthwise of the boat, at least one thrust blade and means mounting the thrust blade on the swing frame for swinging movement therewith about said swing axis and for turning movement relative to the swing frame about a generally upright blade axis, drive means for angularly oscillating said swing frame about said swing axis to swing the thrust blade in a direction crosswise of the boat, said drive means including means for angularly oscillating said thrust blade about the blade axis in timed relation with the angular oscillation of the swing frame, said drive means including a drive shaft mounted on the support structure for rotation about a generally horizontal axis crosswise of the swing axis, a drive head non-rotatably secured to the drive shaft for rotation therewith, a swash plate, means mounting the swash plate for rotation with the drive shaft and for pivotal movement relative thereto about an axis radially of the drive shaft, adjustable means interconnecting said drive head and said swash plate and including a rotary adjusting member mounted on the drive head at a location outwardly of the drive shaft to adjust the angle of the swash plate in response to rotation of said rotary adjusting member, and control means selectively operable to cause rotation of said rotary adjusting member in a first direction to increase the angle of the swash plate or in a second direction to decrease the angle of the swash plate, the improvement wherein said control means comprises:

(a) a first planetary gear set including a first sun gear coaxial with the drive shaft and a first ring gear coaxial with the first sun gear and a first planet gear means in meshing engagement with the first sun gear and the first ring gear, means operatively connecting the first ring gear to the rotary adjusting member for rotating the same in response to angular movement of the first ring gear relative to the drive head, (b) a second planetary gear set including a second sun gear coaxial with the drive shaft and a second ring gear and second planet gear means in meshing engagement with the second sun gear and second ring gear, (c) planet carrier means rotatably supporting the first and second planet gear means, (d) means for rotating the second ring gear with said drive shaft, (e) means for fixing the first sun gear against rotation; and (f) selectively operable means for turning the second sun gear angularly relative to the first sun gear to effect angular movement of the first ring gear relative to the drive head.

2. A boat propulsion apparatus according to claim 1 wherein said adjustable means includes a first threaded member connected to said swash plate and threadedly engaging said rotary adjusting member on said drive head for relative turning about an axis parallel to said drive shaft, said means operatively connecting the first ring gear to the rotary adjusting member including intermeshing gear means on the first ring gear and said rotary adjusting member for rotating the rotary adjusting member relative to the first threaded member in response to turning of the first ring gear relative to the drive head.

3. A boat propulsion apparatus according to claim 1 wherein said adjustable means includes a first threaded member connected to the swash plate and threadedly engaging said rotary adjusting member on the drive head, pinion gear means on the rotary adjusting member, and annular gear means on the first ring gear meshing with the pinion gear means for rotating the rotary adjusting member relative to the first threaded member in response to turning of the first ring gear relative to the drive head.

4. A boat propulsion apparatus according to claim 1 wherein said selectively operable means includes a third planetary gear set including third sun gear means fixed to said second sun gear, third ring gear means, and third planetary gear means in meshing engagement with said third sun gear means and said third ring gear means, a fixed planet carrier rotatably supporting said third planetary gear means, and means engaging said third ring gear means for turning the latter.

5. A boat propulsion apparatus according to claim 4 wherein said adjustable means includes a first threaded member connected to the swash plate and threadedly engaging said rotary adjusting member on the drive head, pinion gear means on the rotary adjusting member, and annular gear means on the first ring gear for meshing with the pinion gear means for rotating the rotary adjusting member relative to the first threaded member in response to turning of the first ring gear relative to the drive head.

6. A boat propulsion apparatus according to claim 4 wherein said third sun gear means is integral with said second sun gear.

7. In a boat propulsion apparatus comprising a support structure, means for mounting the support structure on a boat, at least one swing frame mounted on the support structure for swinging movement relative thereto about a swing axis arranged to extend generally lengthwise of the boat, the swing frame having upper and lower sides and forward and rear sides, at least one thrust blade and means mounting the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat and for angularly oscillating said thrust blade about the generally upright blade axis in timed relation with the angular oscillation of the swing frame, said drive means including a drive shaft mounted on the support structure for rotation about a generally horizontal axis and a swash plate connected to said drive shaft for rotation thereby, swash plate follower means mounted on the swing frame for turning about a follower axis generally radially of the axis of said drive shaft, said swash plate follower means engaging said swash plate for movement thereby in a direction crosswise of the boat and for angular oscillation relative to the swing frame about said follower axis, and means connecting said swash plate follower means to the thrust blade for oscillating said thrust blade in response to angular oscillation of said follower means, the improvement wherein the means mounting the thrust blade on the swing frame includes a rigid shaft housing tube and a tube mounting head rigidly securing the shaft housing tube to the swing frame with the shaft housing tube disposed externally of the frame at the rear side thereof, the thrust blade having blade shaft means rotatably mounted in the shaft housing tube.

8. A boat propulsion apparatus according to claim 7 wherein said shaft housing tube mounting head has means defining a seal face at its lower side spaced above the lower side of the swing frame and generally concentric with the swing axis, said shaft housing tube having a lower portion extending downwardly from the seal face on the tube mounting head and spaced rearwardly from the rear side of the swing frame, housing means secured to said support structure and having an opening therein at a level adjacent the lower side of the tube mounting head to allow the lower portion of the shaft housing tube to extend downwardly therethrough, and seal means on the housing means engaging the seal face for providing a sliding seal between the housing means and the tube mounting head around said opening.

9. A boat propulsion apparatus according to claim 7 including overload release coupling means connecting the thrust blade at an upper end thereof to the blade shaft means at a location below the lower end of the shaft housing tube.

10. A boat propulsion apparatus according to claim 7 including overload release coupling means connecting the thrust blade to the blade shaft means at a location below the lower end of the shaft housing tube, release control means mounted on the blade shaft means above the shaft housing tube and operatively connected to said overload release coupling means, said release control means being adapted to normally hold the overload release coupling means in an engaged condition to drivingly connect the thrust blade to the blade shaft means for movement therewith, the release control means being adapted to yield and allow the overload release coupling means to disengage the driving connection between the thrust blade and blade shaft means when the lateral load on the thrust blade exceeds a preselected load.

11. In a boat propulsion apparatus comprising a support structure, means for mounting the support structure on a boat, at least one swing frame mounted on the support structure for swinging movement relative thereto about a swing axis arranged to extend generally lengthwise of the boat, at least one thrust blade having a blade shaft means and means mounting the blade shaft means of the thrust blade on the swing frame for swinging movement therewith about said swing axis and for turning movement relative to the swing frame about a generally upright blade axis, the thrust blade extending downwardly from the swing frame and having thrust surfaces at opposite sides, drive means for angularly oscillating said swing frame about said swing axis to swing the thrust blade in a direction crosswise of the boat and for angularly oscillating said thrust blade about the generally upright blade axis in timed relation with the angular oscillation of the swing frame, the improvement including an overload release coupling means connecting the thrust blade to the blade shaft means, the overload release coupling means including shaft flange means on a lower end of the blade shaft means, blade flange means on an upper end of the thrust blade, the blade shaft means having lengthwise extending passage means therein, flexible cable means attached to the thrust blade and extending upwardly through the passage means in the blade shaft means, and release control means mounted adjacent an upper end of the blade shaft means and including tension applying means connected to said flexible cable means for drawing the blade flange means against the shaft flange means to normally drivingly connect the thrust blade to the blade shaft means.

12. A boat propulsion apparatus according to claim 11 wherein said release control means includes means operative when the lateral load on the thrust blade exceeds a preselected load for releasing the tension on said cable means.

13. A boat propulsion apparatus according to claim 11 wherein said release control means includes toggle joint means connected to said flexible cable means and movable between an erected condition and a folded condition, and means operative when the tension in said cable means exceeds a preset value for moving the toggle joint means from the erected condition to the folded condition thereof.

14. A boat propulsion apparatus according to claim 11 wherein said release control means includes base means fixed axially with respect to the blade shaft means and a base bracket means movable axially of the blade shaft means relative to the base means, pressure block means on the cable means, toggle joint means operatively connected to the base bracket means and the pressure block means movable between an erected condition and a folded condition, resilient means yieldably urging the base bracket means upwardly relative to the base means and adapted to tension said cable means when the toggle joint means is in the erected condition, and trigger means, operative when the tension in the cable means draws the base bracket means downwardly a preselected distance toward the base means, for moving the toggle joint means to its folded condition.

15. A boat propulsion apparatus according to claim 14 wherein said trigger means includes a bell crank type lever pivotally mounted on the base bracket means and having means on one arm engageable with the toggle joint means and means on a second arm engageable with the base means.

16. A boat propulsion apparatus according to claim 14 including reset wrench means having a handle, an arm means at one end of the handle arranged to engage the pressure block, and pawl means pivoted to the lever intermediate its ends and engageable with the base bracket, the reset wrench means being operable to force the pressure block upwardly relative to the base bracket means.

17. A boat propulsion apparatus according to claim 16 including means on the reset wrench means engageable with the toggle joint means for moving the toggle joint means to the erected condition when the reset wrench means forces the pressure block upwardly relative to the base bracket means.

18. In a boat propulsion apparatus including a support structure adapted for mounting on a boat, at least one swing frame mounted on the support structure for swinging movement relative thereto about a swing axis adapted to extend generally lengthwise of the boat, at least one thrust blade having blade shaft means and means mounting blade shaft means of the thrust blade on the swing frame for swinging movement therewith about said swing axis and for turning movement relative to the swing frame about a generally upright blade axis, drive means for angularly oscillating said swing frame about said swing axis to swing the thrust blade in a direction crosswise of the boat, said drive means including means for angularly oscillating said thrust blade about the blade axis in timed relation with the angular oscillation of the swing frame, said drive means including a drive shaft mounted on the support structure for rotation about a generally horizontal axis crosswise of the swing axis, a drive head non-rotatably secured to the drive shaft for rotation therewith, a swash plate, means mounting the swash plate for rotation with the drive shaft and for pivotal movement relative thereto about an axis radially of the drive shaft, adjustable means interconnecting said drive head and said swash plate and including a rotary adjusting member mounted on the drive head at a location outwardly of the drive shaft to adjust the angle of the swash plate in response to rotation of said rotary adjusting member, and control means selectively operable to cause rotation of said rotary adjusting member in a first direction to increase the angle of the swash plate or in a second direction to decrease the angle of the swash plate, the improvement wherein said means mounting the swash plate for rotation with the shaft includes a drive head fixed to the drive shaft and having a hub portion and a disk portion extending outwardly from the hub portion, said swash plate having an axial opening therethrough receiving said hub portion and said disk portion having a pair of posts extending laterally therefrom, at diametrically opposed locations spaced radially outwardly from the hub portion, a pair of pivot pins mounted on the swash plate to extend generally radially thereof at diametrically opposed locations spaced radially outwardly from said axial opening therein and engaging said pair of posts to pivotally support the swash plate on the pair of posts, said rotary adjusting member being mounted on said disk portion at a location thereon angularly spaced 90° from said pair of posts for rotation relative thereto about an axis parallel to said drive shaft and spaced outwardly therefrom.

19. A boat propulsion apparatus according to claim 18, the further improvement wherein said control means comprises:

(a) a first planetary gear set at the side of said disk portion of the drive head including a first sun gear coaxial with the drive shaft and a first ring gear coaxial with the first sun gear and a first planet gear means in meshing engagement with the first sun gear and the first ring gear, means operatively connecting the first ring gear to the rotary adjusting member for rotating the same in response to angular movement of the first ring gear relative to the drive head, (b) a second planetary gear set including a second sun gear coaxial with the drive shaft and a second ring gear and second planetary gear means in meshing engagement with the second sun gear and second ring gear, (c) planet carrier means rotatably supporting the first and second planet gear means, (d) means for rotating the second ring gear with said drive shaft, (e) means for fixing the first sun gear against rotation; and (f) selectively operable means for turning the second sun gear angularly relative to the first sun gear to effect angular movement of the first ring gear relative to the drive head.

20. A boat propulsion apparatus according to claim 18 wherein said adjustable means includes a first threaded member connected to said swash plate and threadedly engaging said rotary adjusting member on said drive head for relative turning about an axis parallel to said drive shaft, said means operatively connecting the first ring gear to the rotary adjusting member including intermeshing gear means on the first ring gear and said rotary adjusting member for rotating the rotary adjusting member relative to the first threaded member in response to turning of the first ring gear relative to the drive head.

21. A boat propulsion apparatus according to claim 18, the further improvement including an overload release coupling means connecting the thrust blade to the blade shaft means, the overload release coupling means including shaft flange means on a lower end of the blade shaft means, blade flange means on an upper end of the thrust blads, the blade shaft means having lengthwise extending passage means therein, flexible cable means attached to the thrust blade and extending upwardly through the passage means in the blade shaft means, and release control means mounted adjacent an upper end of the blade shaft means and including tension applying means connected to said flexible cable means for drawing the blade flange means against the shaft flange means to normally drivingly connect the thrust blade to the blade shaft means.

22. A boat propulsion apparatus according to claim 21 wherein said release control means includes means operative when the lateral load on the thrust blade exceeds a preselected load for releasing the tension on said cable means.

* * * * *